US012239919B1

(12) United States Patent
Sun

(10) Patent No.: US 12,239,919 B1
(45) Date of Patent: Mar. 4, 2025

(54) WATER PLAY TOY

(71) Applicant: Jiani Zhong, Guangdong (CN)

(72) Inventor: Jianghai Sun, Guangdong (CN)

( * ) Notice: Subject to any disclaimer, the term of this patent is extended or adjusted under 35 U.S.C. 154(b) by 0 days.

(21) Appl. No.: 18/772,341

(22) Filed: Jul. 15, 2024

(30) Foreign Application Priority Data

Jun. 19, 2024 (CN) ..... 202421408074.4

(51) Int. Cl.
*A63H 23/10* (2006.01)
*A63H 29/22* (2006.01)
*A63H 29/24* (2006.01)

(52) U.S. Cl.
CPC ..... *A63H 23/10* (2013.01); *A63H 29/22* (2013.01); *A63H 29/24* (2013.01)

(58) Field of Classification Search
CPC ..... A63H 23/00; A63H 23/10; A63H 23/14; A63H 29/22; A63H 29/24; A63H 33/26
USPC ..... 446/153, 158, 160; 472/128
See application file for complete search history.

(56) References Cited

U.S. PATENT DOCUMENTS 1,257,151 A * 2/1918 Tierney ..... A63H 23/06 446/163
1,480,836 A * 1/1924 Purcell ..... B63H 11/09 60/227
1,556,336 A * 10/1925 McHugh ..... A63H 23/06 446/163
2,984,974 A * 5/1961 Bell ..... A63H 23/04 60/221
9,488,364 B2 * 11/2016 Chien ..... A01K 63/06
10,434,376 B2 * 10/2019 Larson ..... A63B 41/00
12,053,713 B2 * 8/2024 Williams ..... A63H 33/00
2001/0024924 A1 * 9/2001 Ueno ..... A63H 3/28 446/153
2005/0085158 A1 * 4/2005 Tsang ..... A63H 3/24 446/304
2015/0111461 A1 * 4/2015 Lu ..... A63H 23/08 446/153
2018/0001220 A1 * 1/2018 Desautels ..... A63H 23/10

FOREIGN PATENT DOCUMENTS

CN 201684418 U * 12/2010
CN 203736849 U * 7/2014
CN 105498232 A * 4/2016
CN 209994078 U * 1/2020
CN 212593987 U * 2/2021
(Continued)

*Primary Examiner* — Alexander R Niconovich

(57) ABSTRACT

A water play toy includes a housing, a driving device, a power module, a first conductive terminal, and a second conductive terminal. A first accommodating cavity is surrounded and formed by a side wall of the housing, and the housing is equipped with a first opening, a second opening, a liquid inlet, and a liquid outlet. The driving device is positioned in the first accommodating cavity, and the driving device is used for driving liquid to sequentially pass through the liquid inlet and the liquid outlet. The power module is positioned in the first accommodating cavity, and the power module is electrically connected to the driving device. A first end of the first conductive terminal is electrically connected to the power module and the driving device, and a second end of the first conductive terminal is exposed from the housing through an installation channel.

18 Claims, 14 Drawing Sheets

(56) References Cited

FOREIGN PATENT DOCUMENTS

| | | | | | |
|---|---|---|---|---|---|
| CN | 215841583 | U | * | 2/2022 | |
| CN | 116672731 | A | * | 9/2023 | ..... A63H 23/10 |
| CN | 220213913 | U | * | 12/2023 | |
| CN | 220327917 | U | * | 1/2024 | ..... A63H 23/10 |
| CN | 220588924 | U | * | 3/2024 | |
| CN | 220588930 | U | * | 3/2024 | |
| CN | 220588931 | U | * | 3/2024 | |
| CN | 220676755 | U | * | 3/2024 | |
| CN | 220676756 | U | * | 3/2024 | |
| GB | 2153692 | A | * | 8/1985 | ..... A63H 23/04 |
| GB | 2587261 | A | * | 3/2021 | ..... A45D 19/02 |
| GB | 2626784 | A | * | 8/2024 | ..... A61H 33/005 |
| WO | WO-2017111497 | A1 | * | 6/2017 | ..... A63H 23/06 |

* cited by examiner

WATER PLAY TOY

CROSS-REFERENCE TO RELATED APPLICATIONS

The application claims priority of Chinese patent application CN2024214080744, filed on Jun. 19, 2024, which is incorporated herein by reference in its entireties.

TECHNICAL FIELD

The present disclosure relates to the field of toys, in particular to a water play toy.

BACKGROUND ART

Water play toys generally refer to toys that can be played in water. Currently, most water play toys on the market achieve water spraying function through hand pressure. The water play toys in the hand pressure manner is also quite boring to play, resulting in low playability and interest, which can easily make players feel bored and lack fun. Therefore, there is an urgent need on the market to provide a water play toy that can spray water electrically to enhance the fun of water play.

SUMMARY

In order to overcome the shortcomings of the prior art, a water play toy is provided in the present disclosure, including: a housing, wherein a first accommodating cavity is surrounded and formed by a side wall of the housing, and the housing is equipped with a first opening, a second opening, a liquid inlet, and a liquid outlet; a driving device, wherein the driving device is positioned in the first accommodating cavity, and the driving device is used for driving liquid to sequentially pass through the liquid inlet and the liquid outlet; a power module, wherein the power module is positioned in the first accommodating cavity, and the power module is electrically connected to the driving device; a first conductive terminal, wherein a first end of the first conductive terminal is electrically connected to the power module and the driving device, and a second end of the first conductive terminal is exposed from the housing through an installation channel; and a second conductive terminal, wherein a first end of the second conductive terminal is electrically connected to the power module and the driving device, a second end of the second conductive terminal is exposed from the housing through the installation channel, a gap is provided between the second end of the second conductive terminal and the second end of the first conductive terminal, and the second end of the second conductive terminal and the second end of the first conductive terminal can be mutually conductive through a conductive medium.

As an improvement of the present disclosure, the water play toy further includes a waterproof box and a control motherboard. The power module, the driving device, the first conductive terminal, and the second conductive terminal are all electrically connected to the control motherboard. The waterproof box is positioned inside the first accommodating cavity. A waterproof cavity is surrounded and formed by a side wall of the waterproof box. The power module and the control motherboard are both positioned inside the waterproof cavity.

As an improvement of the present disclosure, the installation channel includes the first opening and the second opening. The second end of the first conductive terminal is exposed from the housing through the first opening, and the second end of the second conductive terminal is exposed from the housing through the second opening. The waterproof box is also equipped with a third opening and a fourth opening. The first end of the first conductive terminal is electrically connected to the power module through the third opening, and the first end of the second conductive terminal is electrically connected to the power module through the fourth opening.

As an improvement of the present disclosure, the water play toy also includes a charging port. The charging port is electrically connected to the power module.

As an improvement of the present disclosure, the housing is also equipped with a fifth opening, the waterproof box is also equipped with a sixth opening, and the charging port is exposed from the housing through the fifth opening and the sixth opening.

As an improvement of the present disclosure, the water play toy also includes an elastic sealing plug. The sealing plug detachably covers the fifth opening and the charging port, and the sealing plug is used for sealing the fifth opening and the charging port.

As an improvement of the present disclosure, the housing is also provided with a first installation slot, and the fifth opening is positioned on an inner bottom wall of the first installation slot. Atop surface of the sealing plug is provided with a first sealing protrusion. The first sealing protrusion is detachably inserted into the charging port through the fifth opening, and the first sealing protrusion is used for sealing the charging port. A side surface of the sealing plug is provided with a second sealing protrusion, the second sealing protrusion is pressed against an inner side wall of the first installation slot, and the second sealing protrusion is used for sealing the fifth opening.

As an improvement of the present disclosure, the housing is also equipped with a finger avoidance slot, and the finger avoidance slot is positioned on one side of the first installation slot. At least one portion of the sealing plug is exposed from the first installation slot through the finger avoidance slot.

As an improvement of the present disclosure, a first sealing member is provided between the charging port and an inner wall of the sixth opening. The first sealing member is used for sealing a gap between the charging port and the inner wall of the sixth opening.

As an improvement of the present disclosure, a side wall of the first sealing member is provided with a plurality of sealing convex bars.

As an improvement of the present disclosure, the water play toy further includes a liquid guiding pipe, and the driving device is equipped with a suction opening. The suction opening is in communication with the liquid inlet. One end of the liquid guiding pipe is in communication with the suction opening, and an opposite end of the liquid guiding pipe is in communication with the liquid outlet.

As an improvement of the present disclosure, the water play toy also includes an end cover. One end of the end cover is connected to the liquid guiding pipe, an opposite end of the end cover detachably covers the liquid outlet, and the end cover is in communication with the liquid outlet.

As an improvement of the present disclosure, the liquid outlet is equipped with a first installation protrusion and a second installation protrusion. The end cover is equipped with a third installation protrusion and a fourth installation protrusion. A second installation slot is defined between the first installation protrusion and the second installation protrusion. A third installation slot is defined between the third installation protrusion and the fourth installation protrusion. The third installation protrusion is inserted into the second installation slot, and the second installation protrusion is inserted into the third installation slot.

As an improvement of the present disclosure, the liquid inlet includes one or more water inlet holes, and the liquid outlet includes one or more water outlet holes.

As an improvement of the present disclosure, the waterproof box includes a first upper housing and a first lower housing. The first lower housing is equipped with a fourth installation slot, the first upper housing is equipped with a fifth installation protrusion, and the fourth installation slot is internally equipped with an elastic second sealing member. The first upper housing is connected to the first lower housing, and the fifth installation protrusion is pressed against an upper side of the second sealing member. A lower side of the second sealing member is pressed against an inner bottom wall of the fourth installation slot, so that the waterproof cavity is surrounded and formed by a side wall of the first upper housing and a side wall of the first lower housing.

As an improvement of the present disclosure, the first upper housing is detachably connected to the first lower housing.

As an improvement of the present disclosure, the first upper housing and the first lower housing are detachably connected through a buckle.

As an improvement of the present disclosure, the housing includes a second upper housing and a second lower housing. The second upper housing and the second lower housing are detachably connected.

As an improvement of the present disclosure, the water play toy also includes an installation bracket. The installation bracket is arranged at the liquid inlet, and the driving device is connected to the housing through the installation bracket.

As an improvement of the present disclosure, the housing is equipped with a sixth installation protrusion and a seventh installation protrusion. A fifth installation slot is defined between the sixth installation protrusion and the seventh installation protrusion. The driving device is connected to one side of the installation bracket, and an opposite side of the installation bracket is detachably inserted into the fifth installation slot.

The beneficial effects of the present disclosure are as follows. The water play toy is provided in the present disclosure. The water play toy includes the housing, the driving device, the power module, the first conductive terminal, and the second conductive terminal. The first accommodating cavity is surrounded and formed by the side wall of the housing, and the housing is equipped with the first opening, the second opening, the liquid inlet, and the liquid outlet. The driving device is positioned in the first accommodating cavity, and the driving device is used for driving liquid to sequentially pass through the liquid inlet and the liquid outlet. The power module is positioned in the first accommodating cavity, and the power module is electrically connected to the driving device. The first end of the first conductive terminal is electrically connected to the power module and the driving device, and the second end of the first conductive terminal is exposed to the housing through the installation channel. The first end of the second conductive terminal is electrically connected to the power module and the driving device, the second end of the second conductive terminal is exposed to the housing through the installation channel, the gap is provided between the second end of the second conductive terminal and the second end of the first conductive terminal, and the second end of the second conductive terminal and the second end of the first conductive terminal can be mutually conductive through the conductive medium. Therefore, when the water play toy is placed in the liquid, the second end of the second conductive terminal and the second end of the first conductive terminal can be mutually conductive through the conductive medium in the liquid to activate the driving device, so that the driving device drives the liquid to pass through the liquid inlet and the liquid outlet in sequence and to be sprayed out from the liquid outlet for children to play in water. Moreover, when the driving device drives the liquid to pass through the liquid inlet and the liquid outlet in sequence and to be sprayed out from the liquid outlet, a reaction force generated when the liquid is driven will push the housing to drift on the liquid, thereby improving the fun and ornamental value of the water play toy.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
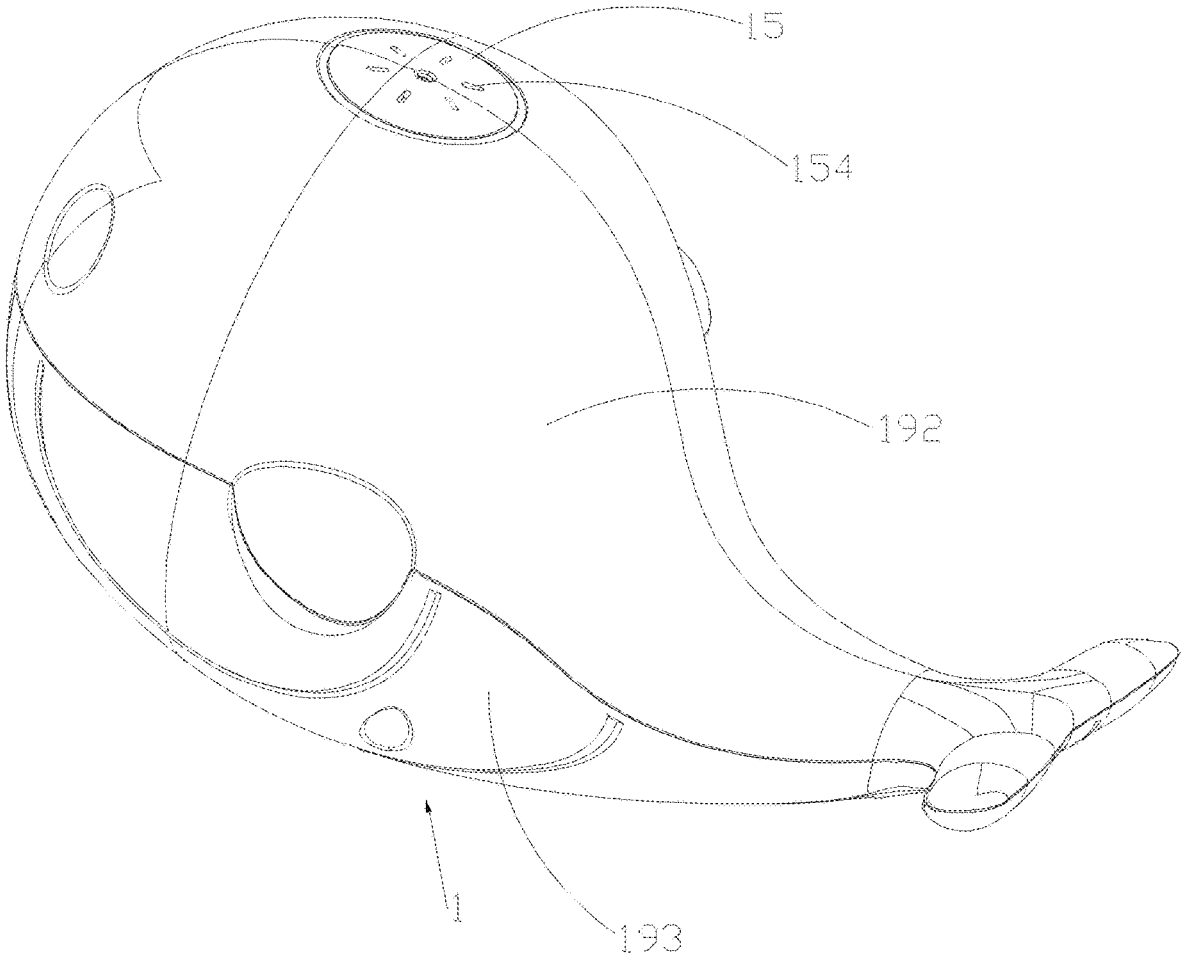
FIG. 1 is a schematic diagram of an overall structure of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Figure 2:
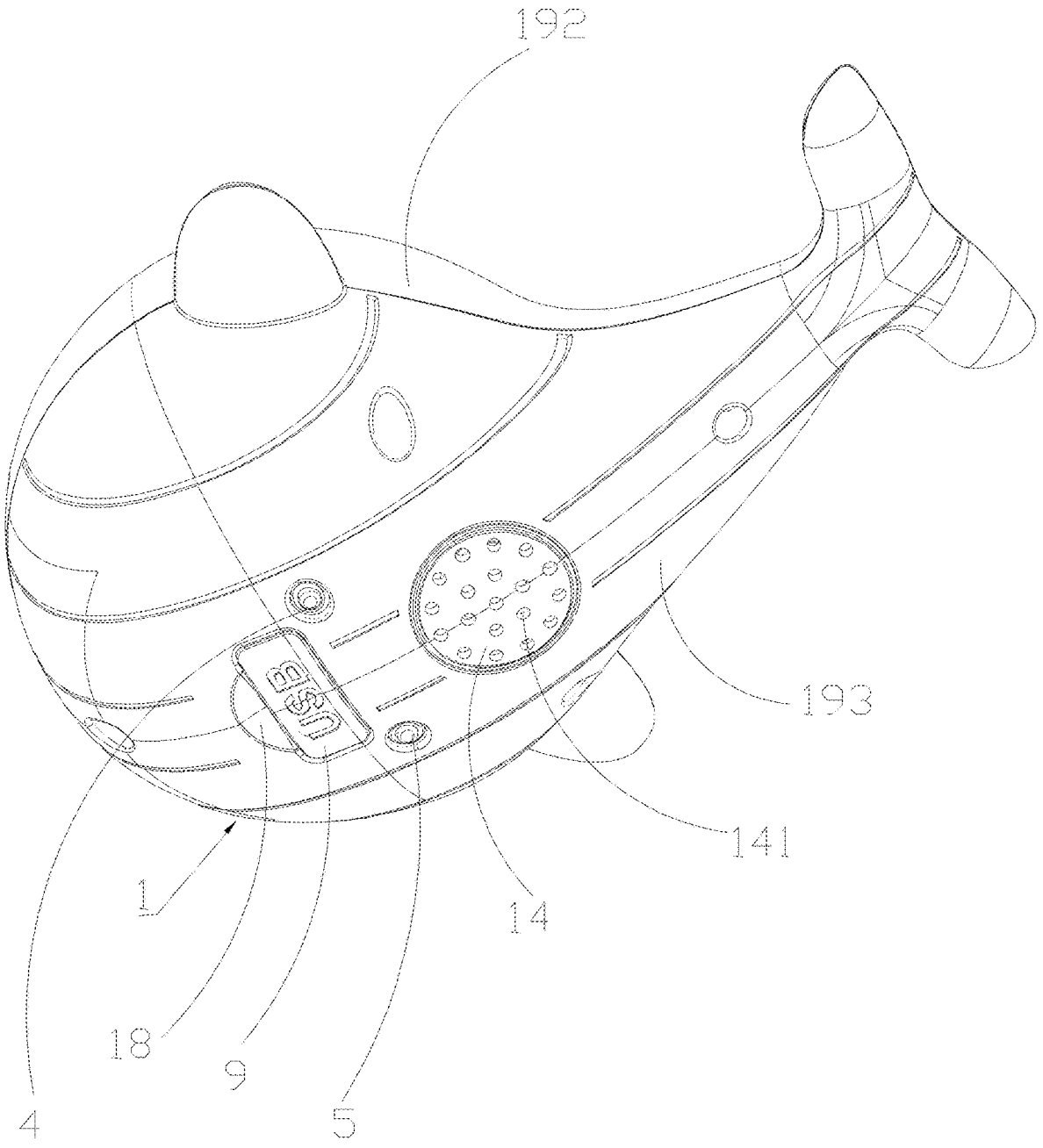
FIG. 2 is another schematic diagram of an overall structure of the present disclosure.
Figure 3:
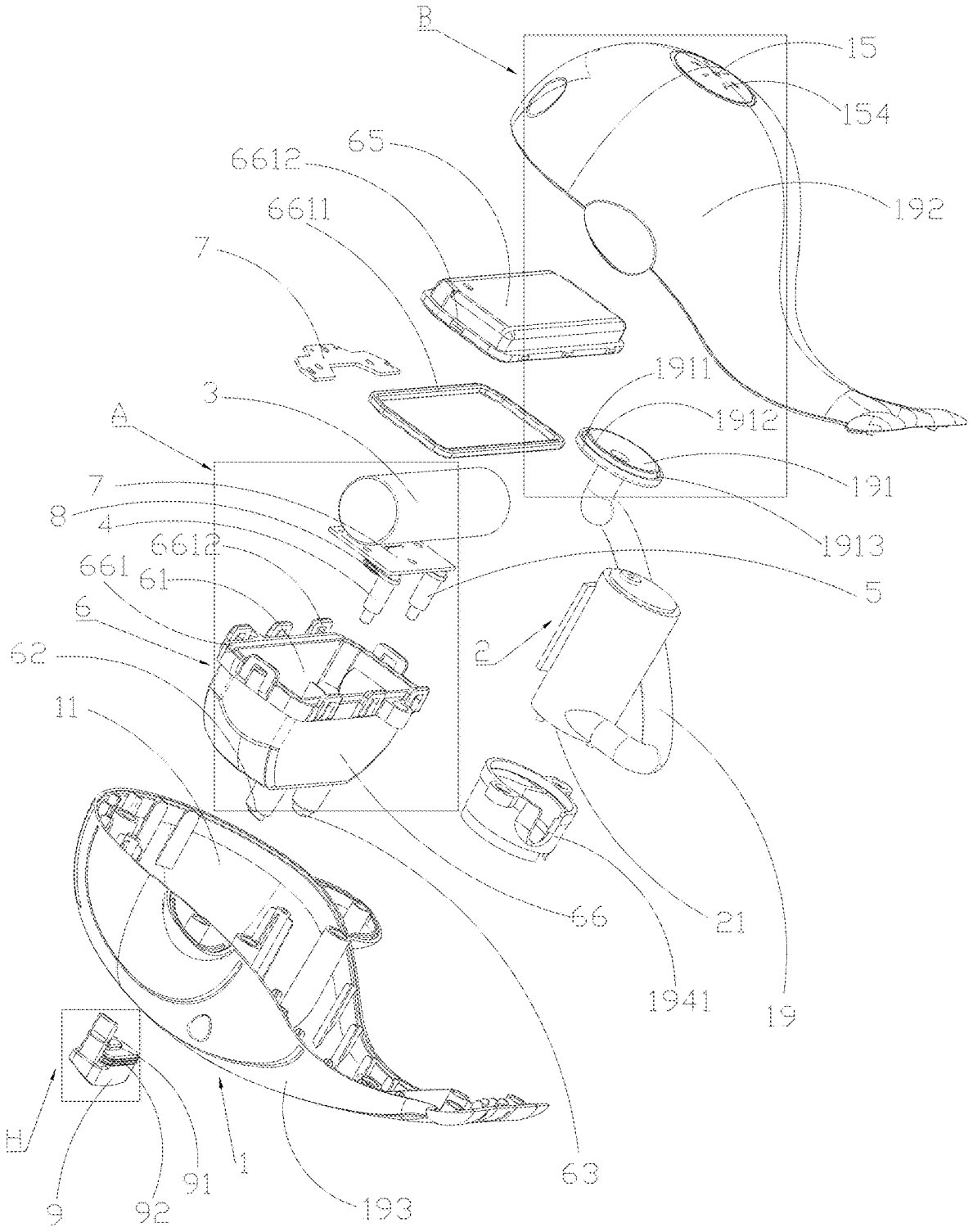
FIG. 3 is an exploded view of the present disclosure.
Figure 4:
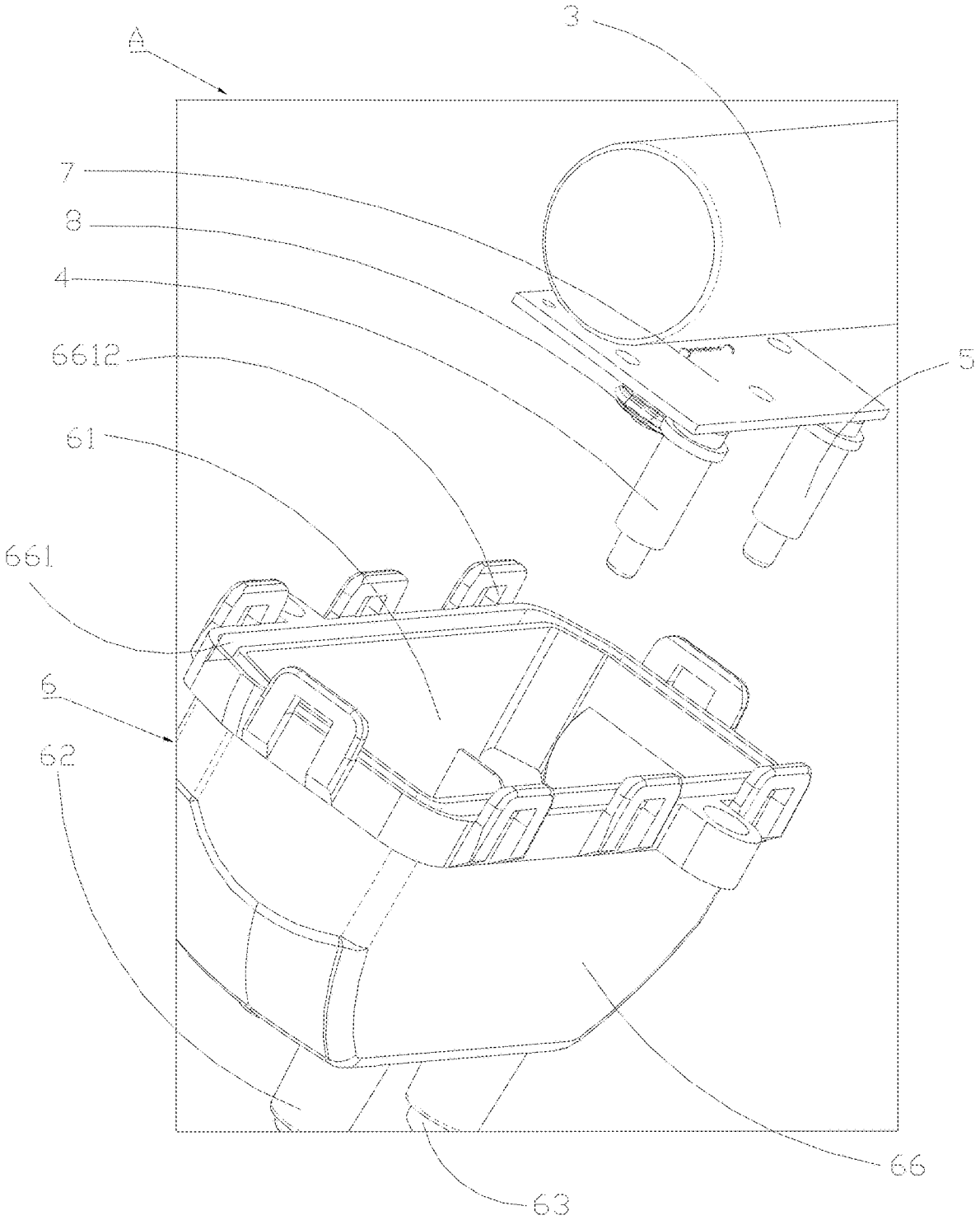
FIG. 4 is an enlarged view of area A in FIG. 3.
Figure 5:
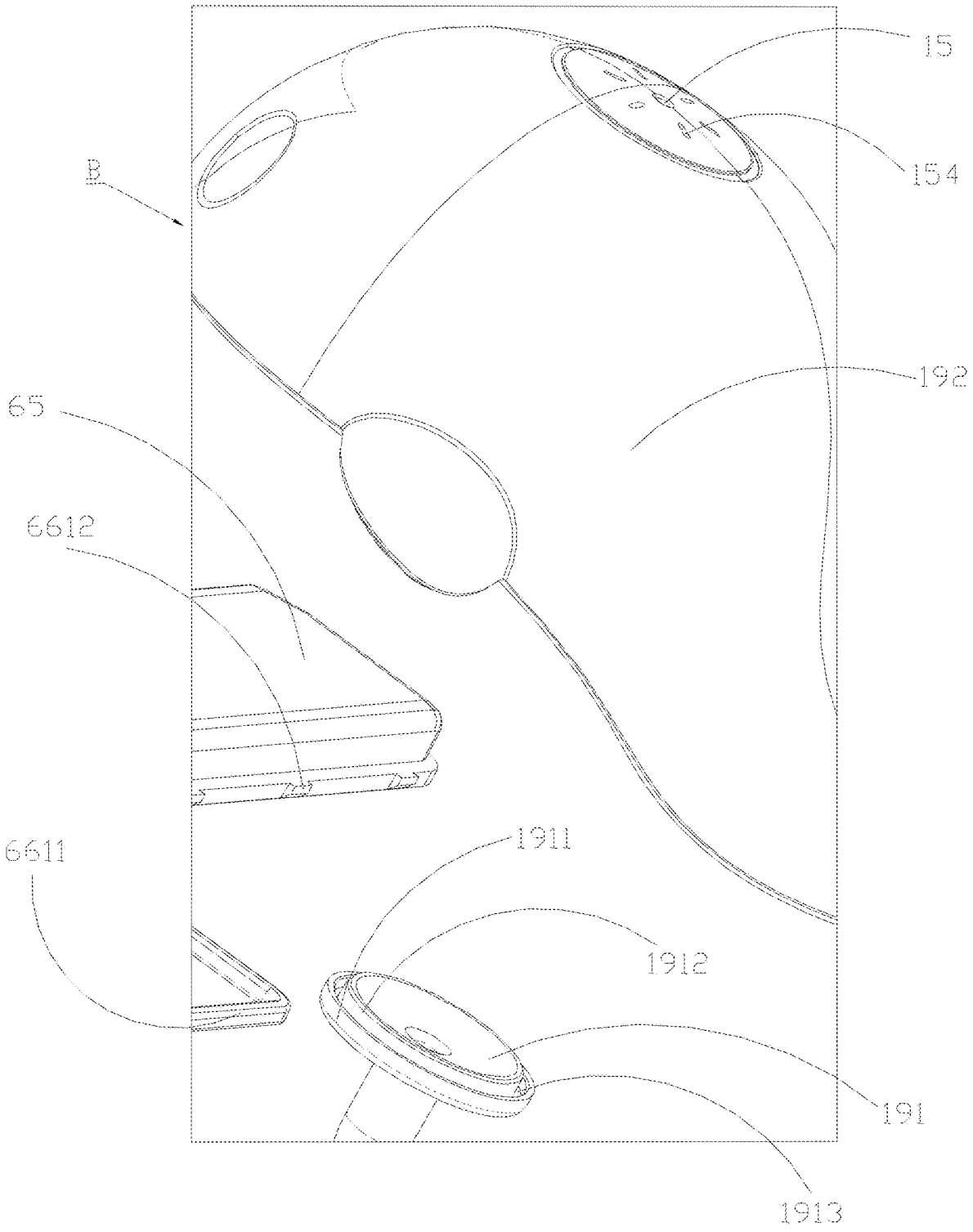
FIG. 5 is an enlarged view of area B in FIG. 3.
Figure 6:
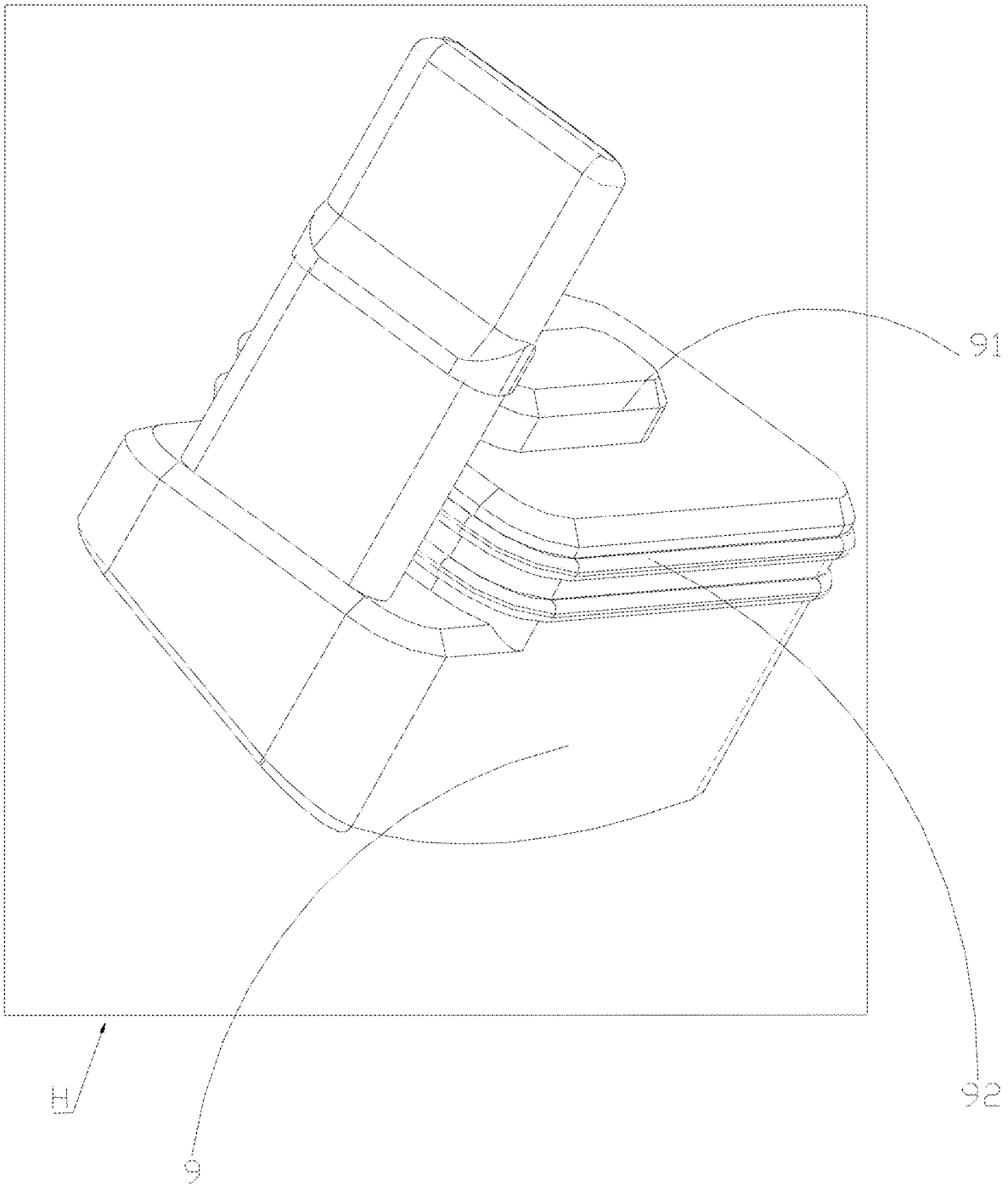
FIG. 6 is an enlarged view of area H in FIG. 3.
Figure 7:
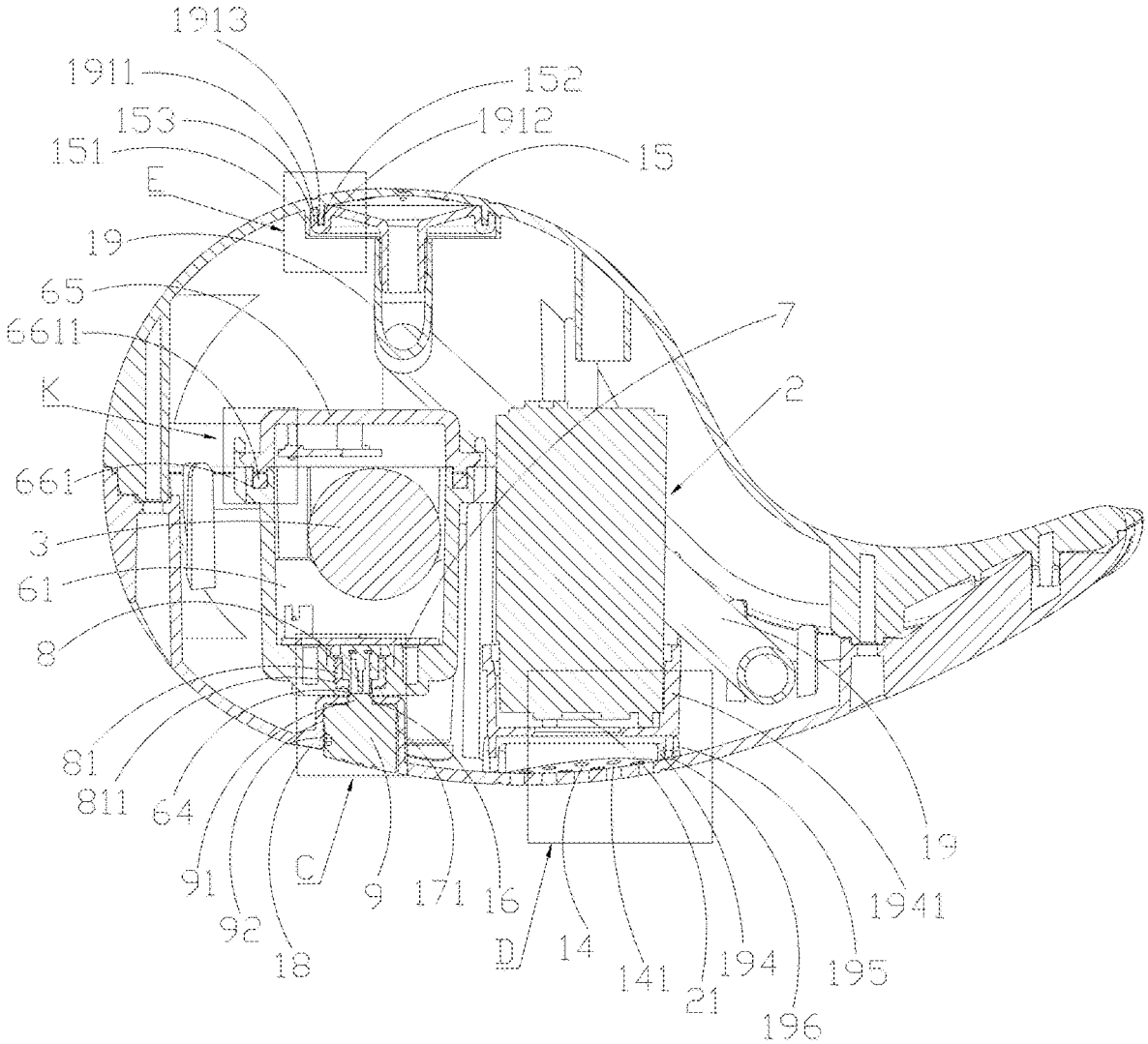
FIG. 7 is a sectional view cut along a sealing plug.
Figure 8:
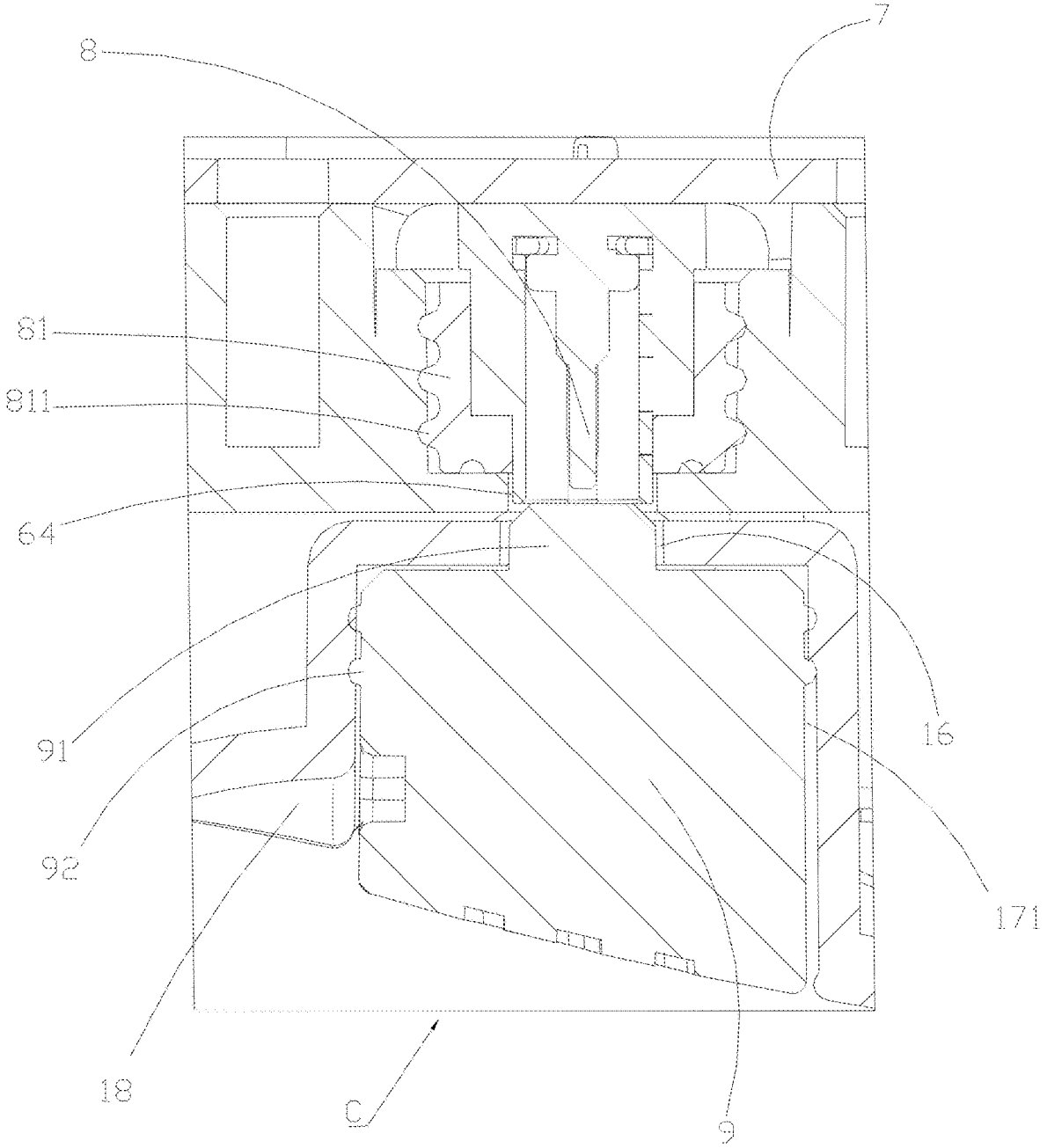
FIG. 8 is an enlarged view of area C in FIG. 7.
Figure 9:
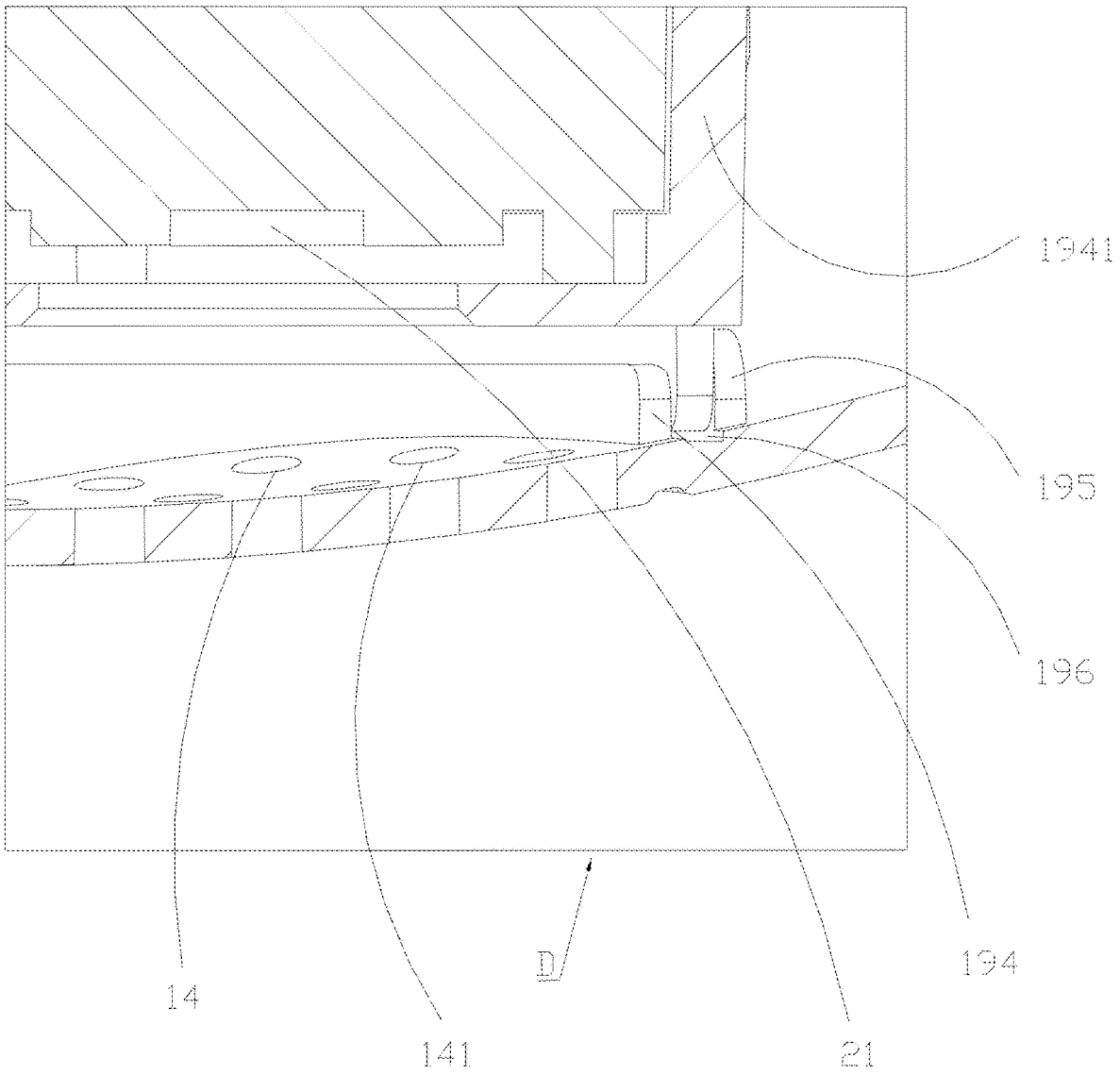
FIG. 9 is an enlarged view of area D in FIG. 7.
Figure 10:
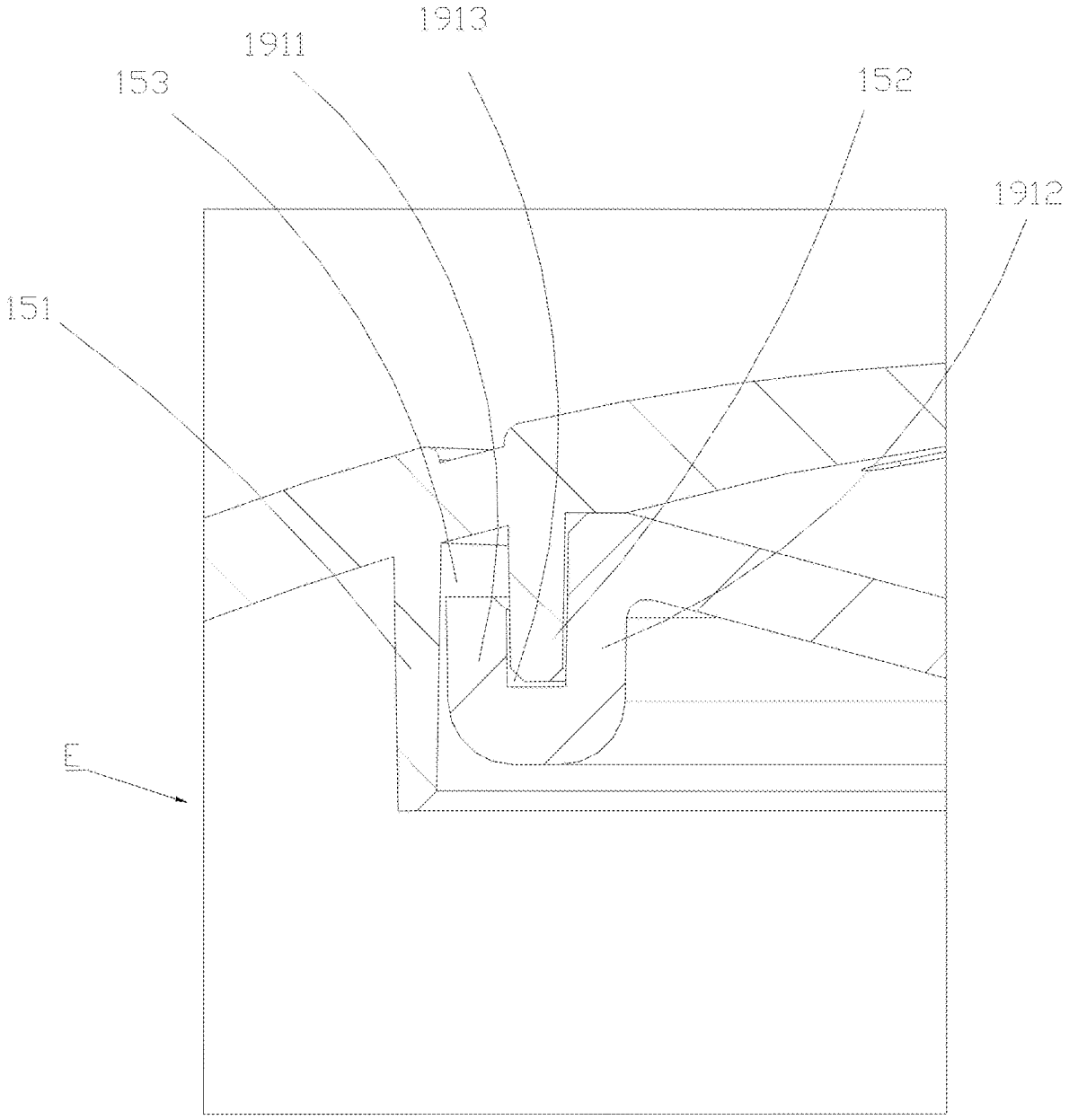
FIG. 10 is an enlarged view of area E in FIG. 7.
Figure 11:
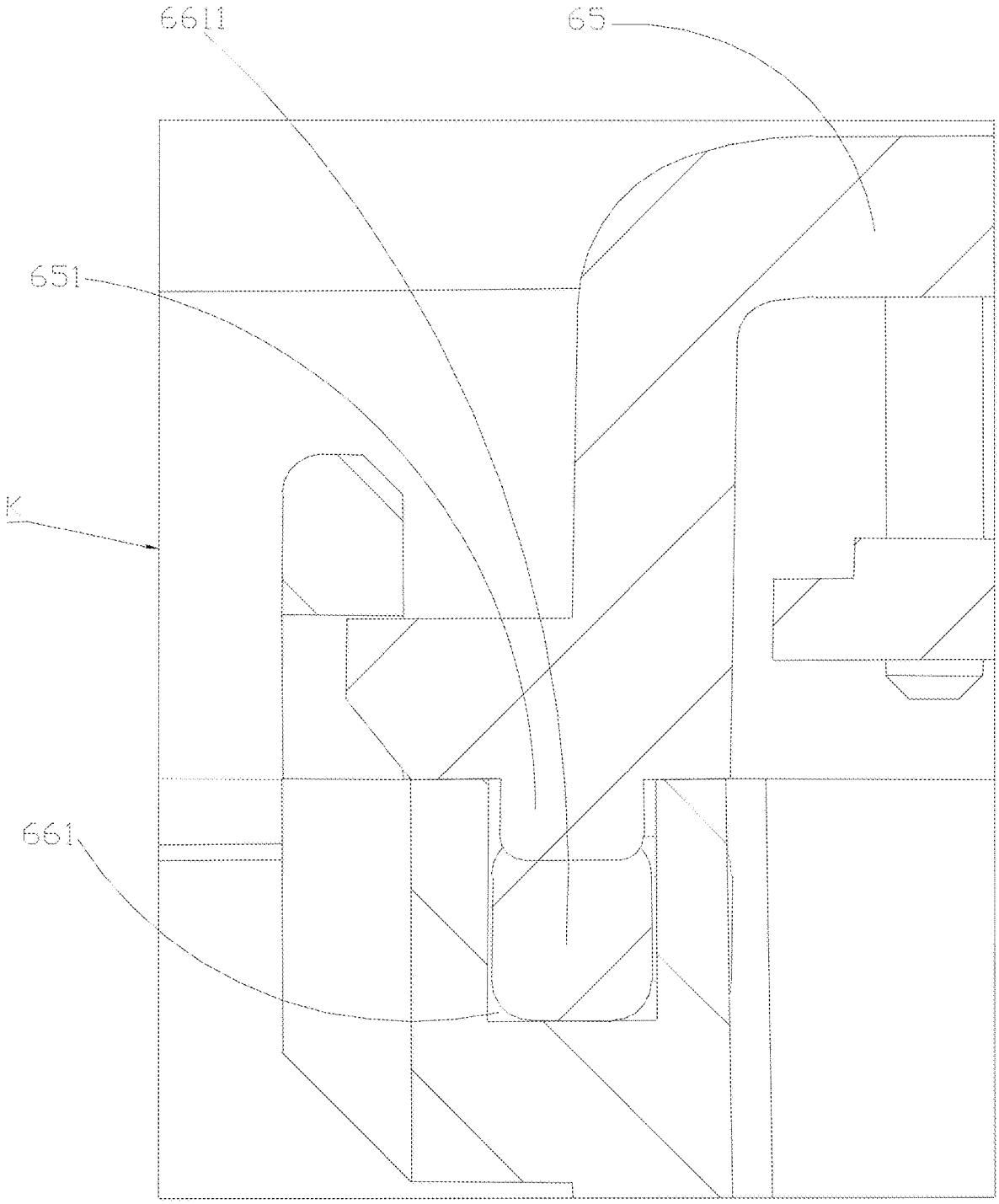
FIG. 11 is an enlarged view of area K in FIG. 7.
Figure 12:
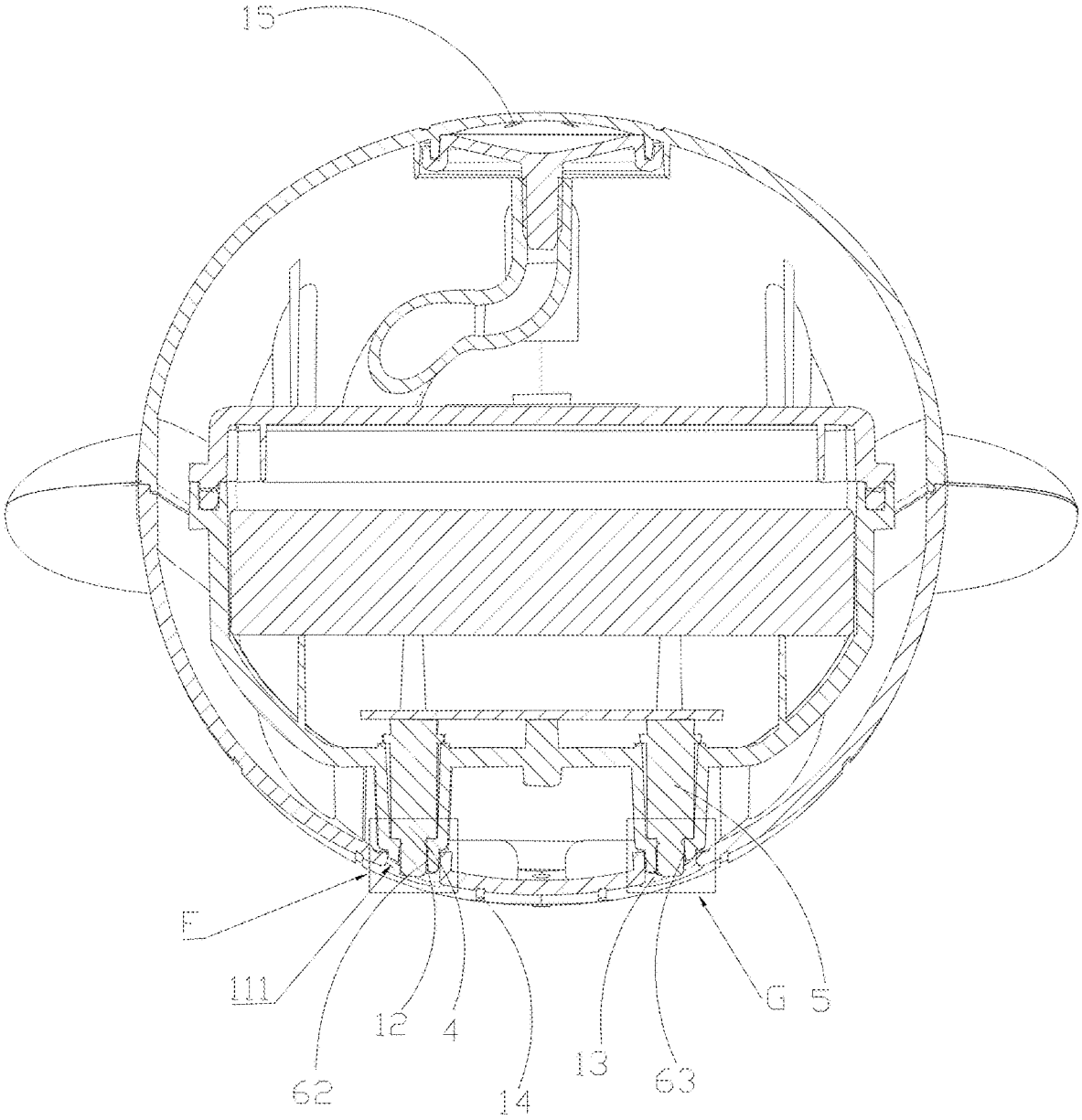
FIG. 12 is a sectional view cut along a first conductive terminal and a second conductive terminal.
Figure 13:
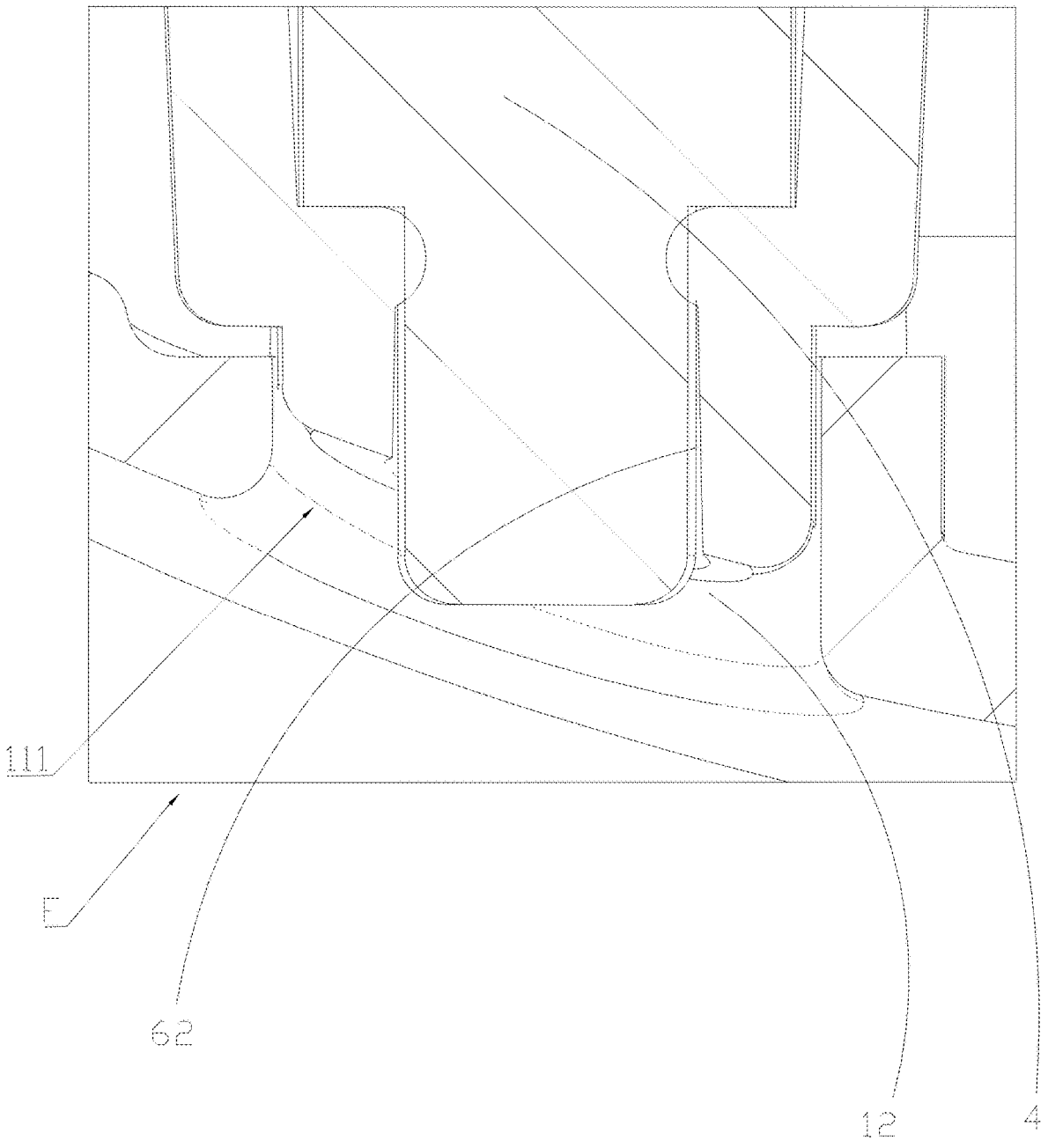
FIG. 13 is an enlarged view of area F in FIG. 12.
Figure 14:
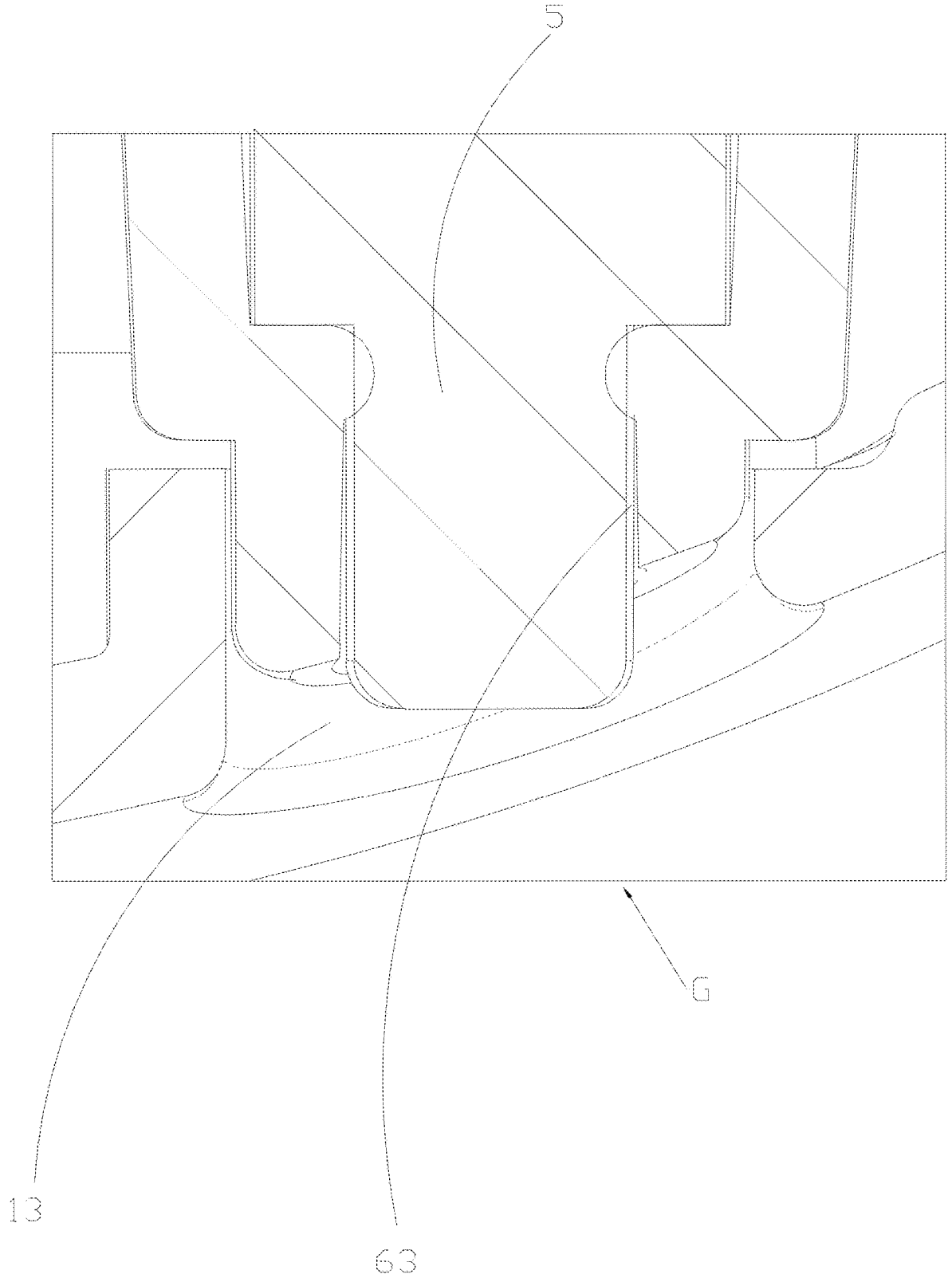
FIG. 14 is an enlarged view of area G in FIG. 12.

Referring to FIGS. 1-4, a water play toy includes: a housing 1, wherein a first accommodating cavity 11 is surrounded and formed by a side wall of the housing 1, and the housing 1 is equipped with a first opening 12, a second opening 13, a liquid inlet 14, and a liquid outlet 15; a driving device 2, wherein the driving device 2 is positioned in the first accommodating cavity 11, and the driving device 2 is used for driving liquid to sequentially pass through the liquid inlet 14 and the liquid outlet 15; a power module 3, wherein the power module 3 is positioned in the first accommodating cavity 11, and the power module 3 is electrically connected to the driving device 2; a first conductive terminal 4, wherein a first end of the first conductive terminal 4 is electrically connected to the power module 3 and the driving device 2, and a second end of the first conductive terminal 4 is exposed from the housing 1 through an installation channel 111; and a second conductive terminal 5, wherein a first end of the second conductive terminal 5 is electrically connected to the power module 3 and the driving device 2, a second end of the second conductive terminal 5 is exposed from the housing 1 through the installation channel 111, a gap is provided between the second end of the second conductive terminal 5 and the second end of the first conductive terminal 4, and the second end of the second conductive terminal 5 and the second end of the first conductive terminal 4 can be mutually conductive through a conductive medium.

Through the above structure, the water play toy includes the housing 1, the driving device 2, the power module 3, the first conductive terminal 4, and the second conductive terminal 5. The first accommodating cavity 11 is surrounded and formed by the side wall of the housing 1, and the housing 1 is equipped with the first opening 12, the second opening 13, the liquid inlet 14, and the liquid outlet 15. The driving device 2 is positioned in the first accommodating cavity 11, and the driving device 2 is used for driving liquid to sequentially pass through the liquid inlet 14 and the liquid outlet 15. The power module 3 is positioned in the first accommodating cavity 11, and the power module 3 is electrically connected to the driving device 2. The first end of the first conductive terminal 4 is electrically connected to the power module 3 and the driving device 2, and the second end of the first conductive terminal 4 is exposed from the housing 1 through the installation channel 111. The first end of the second conductive terminal 5 is electrically connected to the power module 3 and the driving device 2, the second end of the second conductive terminal 5 is exposed from the housing 1 through the installation channel 111, the gap is provided between the second end of the second conductive terminal 5 and the second end of the first conductive terminal 4, and the second end of the second conductive terminal 5 and the second end of the first conductive terminal 4 can be mutually conductive through the conductive medium. Therefore, when the water play toy is placed in the liquid, the second end of the second conductive terminal 5 and the second end of the first conductive terminal 4 can be mutually conductive through the conductive medium in the liquid to activate the driving device 2, so that the driving device 2 drives the liquid to pass through the liquid inlet 14 and the liquid outlet 15 in sequence and to be sprayed out from the liquid outlet 15 for children to play in water. Moreover, when the driving device 2 drives the liquid to pass through the liquid inlet 14 and the liquid outlet 15 in sequence and to be sprayed out from the liquid outlet 15, a reaction force generated when the liquid is driven will push the housing 1 to drift on the liquid, thereby improving the fun and ornamental value of the water play toy.

In this embodiment, the water play toy further includes a waterproof box 6 and a control motherboard 7. The power module 3, the driving device 2, the first conductive terminal 4, and the second conductive terminal 5 are all electrically connected to the control motherboard 7. The waterproof box 6 is positioned inside the first accommodating cavity 11. A waterproof cavity 61 is surrounded and formed by a side wall of the waterproof box 6. The power module 3 and the control motherboard 7 are both positioned inside the waterproof cavity 61. The installation channel 111 includes the first opening 12 and the second opening 13. The second end of the first conductive terminal 4 is exposed from the housing 1 through the first opening 12, and the second end of the second conductive terminal 5 is exposed from the housing 1 through the second opening 13. The waterproof box 6 is also equipped with a third opening 62 and a fourth opening 63. The first end of the first conductive terminal 4 is electrically connected to the power module 3 through the third opening 62, and the first end of the second conductive terminal 5 is electrically connected to the power module 3 through the fourth opening 63. Specifically, the water play toy also includes a charging port 8. The charging port 8 is electrically connected to the power module 3. Furthermore, the housing 1 is also equipped with a fifth opening 16, the waterproof box 6 is also equipped with a sixth opening 64, and the charging port 8 is exposed from the housing 1 through the fifth opening 16 and the sixth opening 64. Furthermore, the water play toy also includes an elastic sealing plug 9. The sealing plug 9 detachably covers the fifth opening 16 and the charging port 8, and the sealing plug 9 is used for sealing the fifth opening 16 and the charging port 8. Furthermore, the housing 1 is also provided with a first installation slot 171, and the fifth opening 16 is positioned on an inner bottom wall of the first installation slot 171. A top surface of the sealing plug 9 is provided with a first sealing protrusion 91. The first sealing protrusion 91 is detachably inserted into the charging port 8 through the fifth opening 16, and the first sealing protrusion 91 is used for sealing the charging port 8. A side surface of the sealing plug 9 is provided with a second sealing protrusion 92, the second sealing protrusion 92 is pressed against an inner side wall of the first installation slot 171, and the second sealing protrusion 92 is used for sealing the fifth opening 16. Furthermore, the housing 1 is also equipped with a finger avoidance slot 18, and the finger avoidance slot 18 is positioned on one side of the first installation slot 171. At least one portion of the sealing plug is exposed from the first installation slot 171 through the finger avoidance slot 18. Through the above structure, as the power module 3 and the control motherboard 7 are positioned in the waterproof cavity 61 of the waterproof box 6, the water can be effectively prevented from entering electronic components such as the power module 3 and the control motherboard 7, thereby improving the waterproof performance of the water play toy, effectively preventing short circuits in the water play toy, and extending the service life of the water play toy. Moreover, since the first sealing protrusion 91 is detachably inserted into the charging port 8 through the fifth opening 16, the first sealing protrusion 91 is used for sealing the charging port 8, the second sealing protrusion 92 is pressed against the inner wall of the first installation slot 171, and the second sealing protrusion 92 is used for sealing the fifth opening 16. Through the dual sealing of the first sealing protrusion 91 and the second sealing protrusion 92, the waterproof performance of the water play toy is further improved, which can prevent liquid from entering electronic components such as the power module 3 and the control motherboard 7 through the charging port 8, effectively preventing short circuits in the water play toy and extending the service life of the water play toy. A total number of the second sealing protrusions 92 is at least two, and at least two second sealing protrusions 92 are arranged sequentially from top to bottom along a side surface of the sealing plug 9. The charging port is a TYPE-C charging port.

In this embodiment, a first sealing member 81 is provided between the charging port 8 and an inner wall of the sixth opening 64. The first sealing member 81 is used for sealing a gap between the charging port 8 and the inner wall of the sixth opening 64. A side wall of the first sealing member 81 is provided with a plurality of sealing convex bars 811. Through the above structure, the first sealing member 81 is installed between the charging port 8 and the inner wall of the sixth opening 64, which can prevent liquid from entering the waterproof cavity 61 of the waterproof box 6 through the gap between the charging port 8 and the inner wall of the sixth opening 64, further improving the waterproof performance of the water play toy.

In this embodiment, the water play toy further includes a liquid guiding pipe 19, and the driving device 2 is equipped with a suction opening 21. The suction opening 21 is in communication with the liquid inlet 14. One end of the liquid guiding pipe 19 is in communication with the suction opening 21, and an opposite end of the liquid guiding pipe 19 is in communication with the liquid outlet 15. The water play toy also includes an end cover 191. One end of the end cover 191 is connected to the liquid guiding pipe 19, an opposite end of the end cover 191 detachably covers the liquid outlet 15, and the end cover 191 is in communication with the liquid outlet 15. Specifically, the liquid outlet 15 is equipped with a first installation protrusion 151 and a second installation protrusion 152. The end cover 191 is equipped with a third installation protrusion 1911 and a fourth installation protrusion 1912. A second installation slot 153 is defined between the first installation protrusion 151 and the second installation protrusion 152. A third installation slot 1913 is defined between the third installation protrusion 1911 and the fourth installation protrusion 1912. The third installation protrusion 1911 is inserted into the second installation slot 153, and the second installation protrusion 152 is inserted into the third installation slot 1913. The liquid inlet 14 includes one or more water inlet holes 141, and the liquid outlet 15 includes one or more water outlet holes 154. The driving device 2 is a water pump. Through the above structure, the installation of the liquid guiding pipe 19 is effectively achieved, and the water pump drives the liquid to flow in the liquid guiding pipe 19 and sprays the liquid out from the liquid outlet 15, which can increase the pressure of the liquid, improve the effect of liquid spraying, and enhance the fun and ornamental value of the water play toy. The first installation protrusion 151 and the second installation protrusion 152 are positioned on an inner wall of the housing.

In this embodiment, the waterproof box 6 includes a first upper housing 65 and a first lower housing 66. The first lower housing 66 is equipped with a fourth installation slot 661, the first upper housing 65 is equipped with a fifth installation protrusion 651, and the fourth installation slot 661 is internally equipped with an elastic second sealing member 6611. The first upper housing 65 is connected to the first lower housing 66, and the fifth installation protrusion 651 is pressed against an upper side of the second sealing member 6611. A lower side of the second sealing member 6611 is pressed against an inner bottom wall of the fourth installation slot 661, so that the waterproof cavity 61 is surrounded and formed by a side wall of the first upper housing 65 and a side wall of the first lower housing 66. The first upper housing 65 is detachably connected to the first lower housing 66. Specifically, the first upper housing 65 and the first lower housing 66 are detachably connected through a buckle 6612. Through the above structure, due to the detachable connection between the first upper housing 65 and the first lower housing 66, it is convenient for a user to install electronic components such as the power module 3 and the control motherboard 7 into the waterproof box 6. By setting the second sealing member 6611 between the first upper housing 65 and the first lower housing 66, the arrangement of the waterproof box 6 is effectively achieved, preventing liquid from seeping into the waterproof box 6 from a gap between the first upper housing 65 and the first lower housing 66. The first sealing member 81 and the second sealing member 6611 are made of silicone or rubber.

In this embodiment, the housing 1 includes a second upper housing 192 and a second lower housing 193. The second upper housing 192 and the second lower housing 193 are detachably connected. The water play toy also includes an installation bracket 1941. The installation bracket 1941 is arranged at the liquid inlet, and the driving device 2 is connected to the housing 1 through the installation bracket 1941. Specifically, the housing 1 is equipped with a sixth installation protrusion 194 and a seventh installation protrusion 195. A fifth installation slot 196 is defined between the sixth installation protrusion 194 and the seventh installation protrusion 195. The driving device 2 is connected to one side of the installation bracket 1941, and an opposite side of the installation bracket 1941 is detachably inserted into the fifth installation slot 196. Through the above structure, the setting of the housing 1 is effectively achieved, and it is convenient for the user to install the waterproof cavity 61 and the driving device 2. The housing 1 is in an animal shape, and the housing 1 can also be in a plant shape. Specifically, the housing 1 is in a whale shape.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A water play toy, comprising:

a housing, wherein a first accommodating cavity is surrounded and formed by a side wall of the housing, and the housing is equipped with an installation channel, a liquid inlet, and a liquid outlet;

a driving device, wherein the driving device is positioned in the first accommodating cavity, and the driving device is used for driving liquid to sequentially pass through the liquid inlet and the liquid outlet;

a power module, wherein the power module is positioned in the first accommodating cavity, and the power module is electrically connected to the driving device;

a first conductive terminal, wherein a first end of the first conductive terminal is electrically connected to the power module and the driving device, and a second end of the first conductive terminal is exposed from the housing through the installation channel; and a second conductive terminal, wherein a first end of the second conductive terminal is electrically connected to the power module and the driving device, a second end of the second conductive terminal is exposed from the housing through the installation channel, a gap is provided between the second end of the second conductive terminal and the second end of the first conductive terminal, and the second end of the second conductive terminal and the second end of the first conductive terminal can be mutually conductive through a conductive medium, wherein the water play toy also comprises a charging port, and the charging port is electrically connected to the power module, the housing is also equipped with a first opening, wherein the water play toy also comprises an elastic sealing plug, the sealing plug detachably covers the first opening and the charging port, and the sealing plug is used for sealing the first opening and the charging port, wherein the housing is also provided with a first installation slot, the first opening is positioned on an inner bottom wall of the first installation slot, a top surface of the sealing plug is provided with a first sealing protrusion, the first sealing protrusion is detachably inserted into the charging port through the first opening, and the first sealing protrusion is used for sealing the charging port; a side surface of the sealing plug is provided with a second sealing protrusion, the second sealing protrusion is pressed against an inner side wall of the first installation slot, and the second sealing protrusion is used for sealing the first opening.

2. The water play toy according to claim 1, wherein the water play toy further comprises a waterproof box and a control motherboard; the power module, the driving device, the first conductive terminal, and the second conductive terminal are all electrically connected to the control motherboard; the waterproof box is positioned inside the first accommodating cavity; a waterproof cavity is surrounded and formed by a side wall of the waterproof box, and the power module and the control motherboard are both positioned inside the waterproof cavity.

3. The water play toy according to claim 2, wherein the installation channel comprises a second opening and a third opening, the second end of the first conductive terminal is exposed from the housing through the second opening, and the second end of the second conductive terminal is exposed from the housing through the third opening; the waterproof box is also equipped with a fourth opening and a fifth opening, the first end of the first conductive terminal is electrically connected to the power module through the fourth opening, and the first end of the second conductive terminal is electrically connected to the power module through the fifth opening.

4. The water play toy according to claim 2, wherein, the waterproof box is also equipped with a sixth opening, and the charging port is exposed from the housing through the first opening and the sixth opening.

5. The water play toy according to claim 4, wherein a first sealing member is provided between the charging port and an inner wall of the sixth opening, and the first sealing member is used for sealing a gap between the charging port and the inner wall of the sixth opening.

6. The water play toy according to claim 5, wherein a side wall of the first sealing member is provided with a plurality of sealing convex bars.

7. The water play toy according to claim 2, wherein the housing is also equipped with a finger avoidance slot, the finger avoidance slot is positioned on one side of the first installation slot, and at least one portion of the sealing plug is exposed from the first installation slot through the finger avoidance slot.

8. The water play toy according to claim 2, wherein the water play toy further comprises a liquid guiding pipe, the driving device is equipped with a suction opening, the suction opening is in communication with the liquid inlet, one end of the liquid guiding pipe is in communication with the suction opening, and an opposite end of the liquid guiding pipe is in communication with the liquid outlet.

9. The water play toy according to claim 8, wherein the water play toy also comprises an end cover, one end of the end cover is connected to the liquid guiding pipe, an opposite end of the end cover detachably covers the liquid outlet, and the end cover is in communication with the liquid outlet.

10. The water play toy according to claim 2, wherein the waterproof box comprises a first upper housing and a first lower housing, the first lower housing is equipped with a fourth installation slot, the first upper housing is equipped with a fifth installation protrusion, the fourth installation slot is internally equipped with an elastic second sealing member, the first upper housing is connected to the first lower housing, the fifth installation protrusion is pressed against an upper side of the second sealing member, a lower side of the second sealing member is pressed against an inner bottom wall of the fourth installation slot, so that the waterproof cavity is surrounded and formed by a side wall of the first upper housing and a side wall of the first lower housing.

11. The water play toy according to claim 10, wherein, the first upper housing is detachably connected to the first lower housing.

12. The water play toy according to claim 1, wherein the liquid inlet comprises one or more water inlet holes, and the liquid outlet comprises one or more water outlet holes.

13. The water play toy according to claim 1, wherein the charging port is a TYPE-C charging port.

14. The water play toy according to claim 1, wherein the housing comprises a second upper housing and a second lower housing, and the second upper housing and the second lower housing are detachably connected.

15. The water play toy according to claim 1, wherein the water play toy also comprises an installation bracket, the installation bracket is arranged at the liquid inlet, and the driving device is connected to the housing through the installation bracket.

16. A water play toy, comprising:

a housing, wherein a first accommodating cavity is surrounded and formed by a side wall of the housing, and the housing is equipped with an installation channel, a liquid inlet, and a liquid outlet;

a driving device, wherein the driving device is positioned in the first accommodating cavity, and the driving device is used for driving liquid to sequentially pass through the liquid inlet and the liquid outlet;

a power module, wherein the power module is positioned in the first accommodating cavity, and the power module is electrically connected to the driving device;

a first conductive terminal, wherein a first end of the first conductive terminal is electrically connected to the power module and the driving device, and a second end of the first conductive terminal is exposed from the housing through the installation channel; and a second conductive terminal, wherein a first end of the second conductive terminal is electrically connected to the power module and the driving device, a second end of the second conductive terminal is exposed from the housing through the installation channel, a gap is provided between the second end of the second conductive terminal and the second end of the first conductive terminal, and the second end of the second conductive terminal and the second end of the first conductive terminal can be mutually conductive through a conductive medium, wherein the water play toy also comprises an end cover, the liquid outlet is equipped with a first installation protrusion and a second installation protrusion, the end cover is equipped with a third installation protrusion and a fourth installation protrusion, a second installation slot is defined between the first installation protrusion and the second installation protrusion, a third installation slot is defined between the third installation protrusion and the fourth installation protrusion, the third installation protrusion is inserted into the second installation slot, and the second installation protrusion is inserted into the third installation slot.

17. The water play toy according to claim 16, wherein the water play toy further comprises a liquid guiding pipe, the driving device is equipped with a suction opening, the suction opening is in communication with the liquid inlet, one end of the liquid guiding pipe is in communication with the suction opening, and an opposite end of the liquid guiding pipe is in communication with the liquid outlet, wherein one end of the end cover is connected to the liquid guiding pipe, an opposite end of the end cover detachably covers the liquid outlet, and the end cover is in communication with the liquid outlet.

18. A water play toy, comprising:

a housing, wherein a first accommodating cavity is surrounded and formed by a side wall of the housing, and the housing is equipped with an installation channel, a liquid inlet, and a liquid outlet;

a driving device, wherein the driving device is positioned in the first accommodating cavity, and the driving device is used for driving liquid to sequentially pass through the liquid inlet and the liquid outlet;

a power module, wherein the power module is positioned in the first accommodating cavity, and the power module is electrically connected to the driving device;

a first conductive terminal, wherein a first end of the first conductive terminal is electrically connected to the power module and the driving device, and a second end of the first conductive terminal is exposed from the housing through the installation channel; and a second conductive terminal, wherein a first end of the second conductive terminal is electrically connected to the power module and the driving device, a second end of the second conductive terminal is exposed from the housing through the installation channel, a gap is provided between the second end of the second conductive terminal and the second end of the first conductive terminal, and the second end of the second conductive terminal and the second end of the first conductive terminal can be mutually conductive through a conductive medium, wherein the water play toy also comprises an installation bracket, the installation bracket is arranged at the liquid inlet, and the driving device is connected to the housing through the installation bracket, wherein the housing is equipped with a first installation protrusion and a second installation protrusion, an installation slot is defined between the first installation protrusion and the second installation protrusion, the driving device is connected to one side of the installation bracket, and an opposite side of the installation bracket is detachably inserted into the installation slot.

* * * * *